US006216996B1

(12) United States Patent
Shamoon

(10) Patent No.: US 6,216,996 B1
(45) Date of Patent: Apr. 17, 2001

(54) LIVE HINGE FOR CLIPBOARD CLIP

(76) Inventor: Ellis N. Shamoon, 2833 Park Bridge Ct., Dallas, TX (US) 75219

( * ) Notice: Subject to any disclaimer, the term of this patent is extended or adjusted under 35 U.S.C. 154(b) by 0 days.

(21) Appl. No.: 09/153,176

(22) Filed: Sep. 15, 1998

(51) Int. Cl.[7] ..... A47B 97/04; B42F 1/02; B42F 1/00

(52) U.S. Cl. ..... 248/452; 24/67.9; 24/545; 24/3.12; 24/67.11; 248/450; 248/451

(58) Field of Search ..... 248/450, 451, 248/452, 441.1; 24/545, 67.9, 3.12, 67.1, 67.11; 211/45, 50; 108/44; 281/45, 42, 51

(56) References Cited

U.S. PATENT DOCUMENTS

| | | | | |
|---|---|---|---|---|
| D. 255,251 | | 6/1980 | Hanson et al. | D19/88 |
| D. 379,477 | | 5/1997 | Shamoon | D19/88 |
| D. 388,463 | | 12/1997 | Sullins et al. | D19/88 |
| D. 422,311 | * | 4/2000 | Shamoon | D19/65 |
| 1,019,348 | * | 3/1912 | Northam . | |
| 3,423,798 | * | 1/1969 | O'Donnell | 24/66 |
| 3,977,744 | | 8/1976 | Dewitt | 312/231 |
| 4,105,182 | | 8/1978 | Jacobson | 248/459 |
| 4,892,334 | | 1/1990 | Sinclair | 281/45 |
| 5,116,012 | * | 5/1992 | Offenhauer | 248/452 |
| 5,145,141 | | 9/1992 | Hunter | 248/452 |
| 5,253,943 | | 10/1993 | Miyashita | 402/68 |
| 5,297,814 | | 3/1994 | Peters | 281/45 |
| 5,312,082 | | 5/1994 | Chang | 248/452 |
| 5,324,076 | | 6/1994 | Nieradka | 281/45 |
| 5,441,228 | | 8/1995 | Geborek | 248/441.1 |
| 5,658,014 | * | 8/1997 | Barker et al. | 281/45 |
| 5,732,925 | | 3/1998 | Shamoon | 248/452 |
| 5,774,946 | * | 7/1998 | Morgan | 24/67.5 |
| 6,024,384 | * | 2/2000 | Jones et al. | 281/45 |
| 6,061,882 | * | 5/2000 | Otte-Wiese | 24/487 |

* cited by examiner

*Primary Examiner*—Leslie A. Braun
*Assistant Examiner*—Steven Marsh
(74) *Attorney, Agent, or Firm*—Daniel V. Thompson

(57) ABSTRACT

A live hinge for clipboard clip box (10) having a cover (12) which comprises a cover rear (12A), cover front (12F), cover left side (12L), cover right side (12R), cover top (12T), and cover bottom (12B). The live hinge for clipboard clip box (10) has a box (14) which comprises a box rear (14A), box front (14F), box bottom (14B), box left (14L), and box right (14R), the cover top (12T) is hingeably connected along a front to a top distal end of the box front (14F). The live hinge for clipboard clip box (10) and abase (18) connected to the box bottom (14B) by a hinge (20).The live hinge for clipboard clip box (10) has a board (24) securely attached at a top to the base (18), a user lifts box front (14F) pivoting the box (14) upwardly on the hinge (20) inserting paper (26) from a frontward direction between a top of the base (18). and the box bottom (14B).

20 Claims, 9 Drawing Sheets

LIVE HINGE FOR CLIPBOARD CLIP

TECHNICAL FIELD

The present invention relates to a clipboard clip hinge. More particularly, the present invention relates to a live hinge for clipboard clip.

BACKGROUND ART

Clipboards are well known in the art. They range in configurations, size and purpose. Some have boxes to store writing utensils but none have a box in combination with a live hinge system to hold paper or any other writeable material.

Numerous innovations for clipboards have been provided in the prior art that are described as follows. Even though these innovations may be suitable for the specific individual purposes to which they address, they differ from the present invention as hereinafter contrasted.

In U.S. Pat. No. , D388463, titled, Clipboard with padded writing surface, by inventors, Sullins, et. al. In U.S. Pat. No. , D379477, titled, Clipboard/storage box, by inventor, Shainoon and in U.S. Pat. No. , D255251, titled, Combined portable container and clipboard, by inventors, Hansen, et. al., all exhibit ornamental designs of clipboards lacking a live hinge.

In U.S. Pat. No. , 4,105,182, titled, Multiple use study device, by inventor, Jacobson, alcollapsible and portable book stand, formed from a single elongated blank of light weight material, such as cardboard, transversely creased to form a plurality of foldable panels which are adapted to lock into a plurality of positions each of which is adapted for a different purpose such as holding and supporting an opened book in a rearwardly inclined position for ease of viewing, for use as a cover or support, for use as a folder for notepads, a hand-held support for such items as a note or sketch pad, a storage bin for books or like articles, a book rack, a pen-pencil and ruler holder, a lectern, a study carrel, a clipboard easel for typists, a music stand, a projection screen prop or a technical drawing board prop.

In U.S. Pat. No. , 5,297,814, titled, Clipboard for teaching children to write correctly, by inventor, Peters, a clipboard which attaches by means of a lip provided on a lower edge of the clipboard to a front edge of a typical school desktop so that the clipboard lies flat against the desktop. The clipboard is provided with an upper area which is tilted either left or right with respect to the front edge of the desktop, the angle of the tilt being that required for proper paper placement for writing and the direction of the tilt being dependent upon whether the clipboard is designed for a right-handed or left-handed student. The upper area is provided with horizontal writing lines and is preferably made of an erasable material so the student can mark directly on it. A clip is provided for securing paper to the clipboard. A number line and an alphabet are also provided on the clipboard, with each numeral and each letter being provided with a dot and one or more arrows to indicate proper initial placement and proper movement of a writing instrument to correctly make the numeral or letter.

In U.S. Pat. No. , 5,253,943, titled, Plastic clipboard having elastic engaging pins, by inventor, Miyashita, a clipboard for holding worksheets is disclosed, which is a plastic rectangular board bent into a largely inverted U-shaped cross-section having a vertical front board, an also vertical backside board that is larger in length than the front board, and a horizontal top roof member between the front and backside boards. A book of worksheets is clamped between the front and backside boards below the roof member. A hook for hanging the clipboard is centrally fixed in the roof member and having means t orient the clamped worksheets in two alternative different vertical planes perpendicular to each other. A pair of bosses centrally mounted in the backside board and each having at a front end thereof a downwardly inclined end face for engagement with a pair of apertures formed in the front board through a pair of holes in an upper margin of each worksheet clamped.

In U.S. Pat. No. , 5,732,925, titled, Clipboard with art supply container, by inventor, Shamoon, a combination of a clipboard and art supply container is provided. The clipboard includes a board and a clip attached to the board. The clip is specially constructed and adapted to removably hold the art supply container. Multiple art supply containers may be furnished containing different art supply media In U.S. Pat. No. , 4892334, titled, Portable clipboard and storage box , by inventor, Sinclair, a portable clipboard includes an integral storage box for transporting various accessories such as pens, pencils, erasers, rulers, calculators, etc. The writing surface of the clipboard is provided with a spring retaining clip for securing papers and is mounted by a hinge to a shallow rectangular box. In a second embodiment, a battery operated light is secured by a flexible stem on the upper surface of the clipboard and a digital clock is also provided.

In U.S. Pat. No. , 3,977,744, titled, Posse box report clip board, by inventor, DeWitt, a combination two-compartment clip board for containing report forms and reports and providing a writing surface for preparing reports is disclosed.

In U.S. Pat. No. , 5,441,228, titled, Document holding and display device, by inventor, Geborek, a document holding and displaying apparatus which holds a plurality of documents and displays one of the documents. The apparatus includes a first support member which is generally of the same size of the documents, to which the documents are secured at a first edge by a spring biased clip. A second support member is hinged adjacent a first edge to the first support member adjacent to its first edge. Documents on top of the document to be displayed are folded over a second edge of the second support member which is one half the length of the first support member. The edges of the first and second support members perpendicular to the first edges are provided with inwardly facing channels for retaining the edges of the documents.

In U.S. Pat. No. , 5,145,141, titled, Clipboard, by inventor, Hunter, a clipboard adapted for multi-functional use is disclosed. The clipboard includes a pair of panel-like members which are releasably joined to one another to form an assembly. The panel-like members are separable one from another whereby a sheet of paper having information printed thereon may be inserted between the panel members to be interposed therebetween. One or both of the panel members is fabricated from a transparent material which permits the user to view the information on the sheet of paper through the panel member itself. A conventional clip assembly is mounted on one or both of the panels to releasably retain a sheet of paper atop one of the panels whereby the user may either read or write on the paper utilizing the -underlying panel as a writing surface.

In U.S. Pat. No. , 5,324,076, titled, Clip board with storage drawer, by inventor, Nieradka, a portable clipboard is provided for use by medical professionals with a latching, pullout drawer with an integral storage area for prescription pads, medical forms and writing implements. The top surface incorporates a clip to secure documents and the pullout drawer can be moved to the open position while maintaining the top surface in position for writing.

In U.S. Pat. No. , 5312082, titled, Clipboard having a whistle integrally formed therewith, by inventor, Chang, a clipboard includes a backing board on which a clip member is mounted pivotally, a torsional spring unit arranged between the backing board and the clip member so as to bias one end of the clip member to abut against the backing board, and a whistle formed integrally with the clip member.

Numerous innovations for clipboards have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a live hinge for clipboard clip. The uniqueness of the present invention is that it has a live hinge composed of a hinge longitudinally disposed and attached along opposite distal edges to a bottom and a base. The hinge includes a hinge top and a hinge bottom. A feature of the invention is that the hinge bottom is of a thickness that enhances stiffness, about 0.08 to 0.15 inches, while the hinge top tapers vertically to a relatively thin thickness, about 0.025 to 0.05 inches, to promote flexibility at the extreme top of hinge top. The live binge may include hooks extending downwardly from the clip bottom and hooks extending upwardly from the base connected by clips which function as a biasing means.

The types of problems encountered in the prior art are the clips require cumbersome and non-weatherproof biasing means such as springs.

In the prior art, unsuccessful attempts to solve this problem were attempted namely: springs manufactured from corrosion resistant materials. However, the problem was solved by the present invention because the biasing means is preferably constructed from lightweight plastic or plastic composite.

The present invention went contrary to the teaching of the art which describes and claims spring loaded biasing means and clips lacking the features described and claimed in the present invention.

The present invention solved a long felt need for a lightweight inexpensive clip.

Accordingly, it is an object of the present invention to provide a live hinge for clipboard clip having a base, hinge, and clip.

More particularly, it is an object of the present invention to provide a cover having a cover rear, cover front, cover left side, cover right side, cover top, cover bottom, cover eyelet, and cover skirt.

In keeping with these objects, and with others which will become apparent hereinafter, one feature of the present invention resides, briefly stated, in the cover top having a cover top grip and a cover top tab with a cover top tab grip.

When the box is designed in accordance with the present invention, it has a box rear, a box front, a box bottom, a box left, and a box right.

In accordance with another feature of the present invention, the box rear has a box rear lock, a box rear right hook, and a box rear left hook.

Another feature of the present invention is that the box bottom has a box bottom right holder and a box bottom left holder.

Yet another feature of the present invention is that the base has a base right hook, base left hook, base right opening, base left opening, base front-back ridge, base left-right ridge, and base rest.

Still another feature of the present invention is that the invention has a left clip and a right clip.

Yet still another feature of the present invention is that the invention is securely attachable to a board to hold paper.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

List of Reference Numbers Utilized in The Drawings

10—live hinge for clipboard clip box (10)
12—cover (12)
12A—cover rear (12A)
12F—cover front (12F)
12L—cover left side (12L)
12R—cover right side (12R)
12T—cover top (12T)
12TA—cover top grip (12TA)
12TB—cover top tab (12TB)
12TBA—cover top tab grip (12TBA)
12B—cover bottom (12B)
12C—cover eyelet (12C)
12D—cover skirt (12D)
14—box (14)
14A—box rear (14A)
14AB—box rear lock (14AB)
14AR—box rear right hook (14AR)
14AL—box rear left hook (14AL)
14F—box front (14F)
14B—box bottom (14B)
14BBR—box bottom right holder (14BBR)
14BBL—box bottom left holder (14BBL)
14L—box left (14L)
14R—box right (14R)
16—holder (16)
18—base (18)
18AR—base right hook (18AR)
18AL—base left hook (18AL)
18BR—base right opening (18BR)
18BL—base left opening (18BL)
18CA—base front-back ridge (18CA)
18CB—base left-right ridge (18CB)
18D—base-rest (18D)
20—hinge (20)
20T—hinge top (20T)
20B—hinge bottom (20B)
22L—left clip (22L)
22R—right clip (22R)
24—board (24)
26—paper (26)

BRIEF DESCRIPTION OF THE DRAWINGS

A more complete understanding of the invention and its advantages will be apparent from the Detailed Descnption taken in conjunction with the accompanying Drawings, in which.

DETAILED DESCRIPTION OF THE PREFERRED EMBODIMENT

Figure 1:
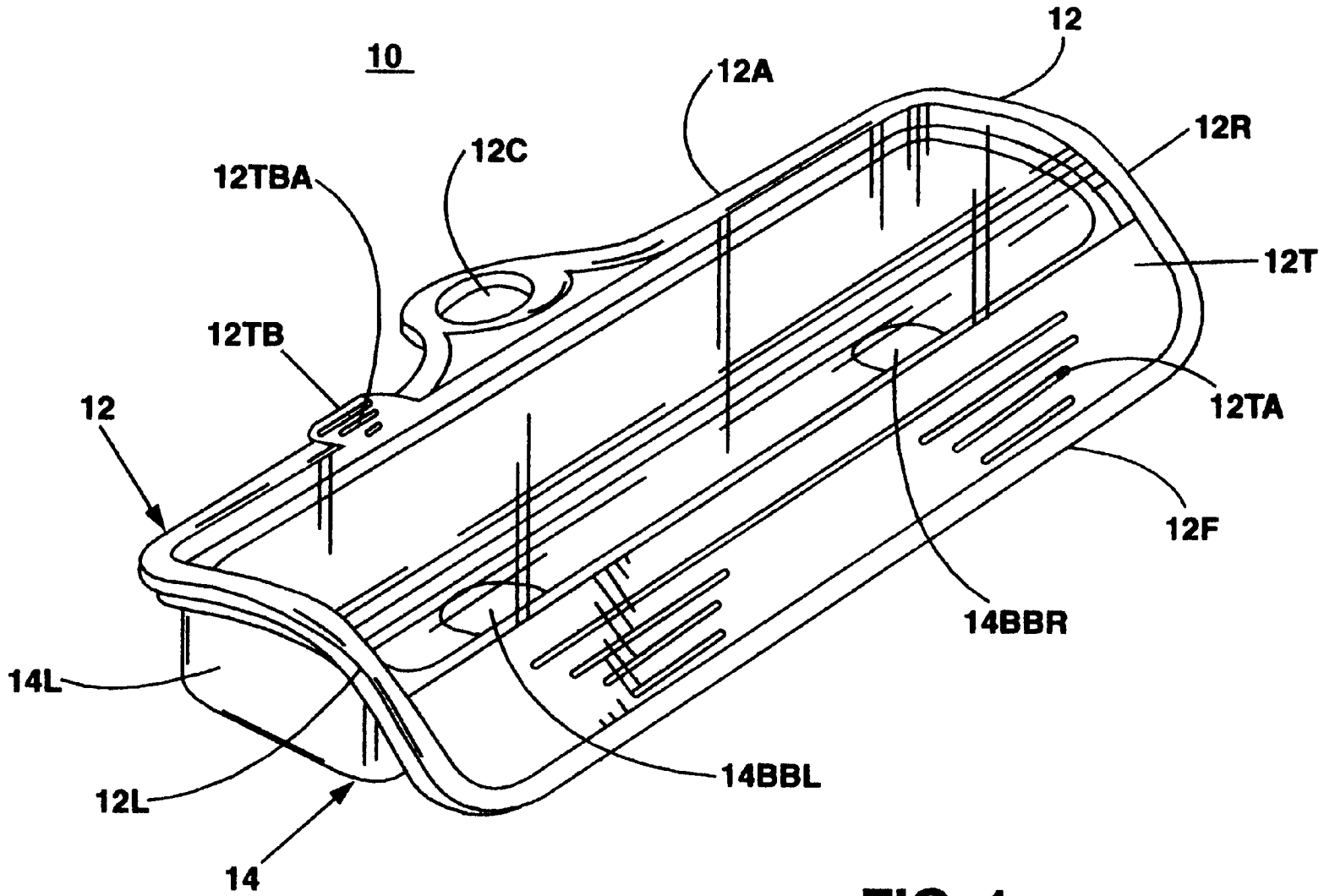
FIG. 1 is a left front top perspective view of a live hinge for clipboard clip box.
Figure 2:
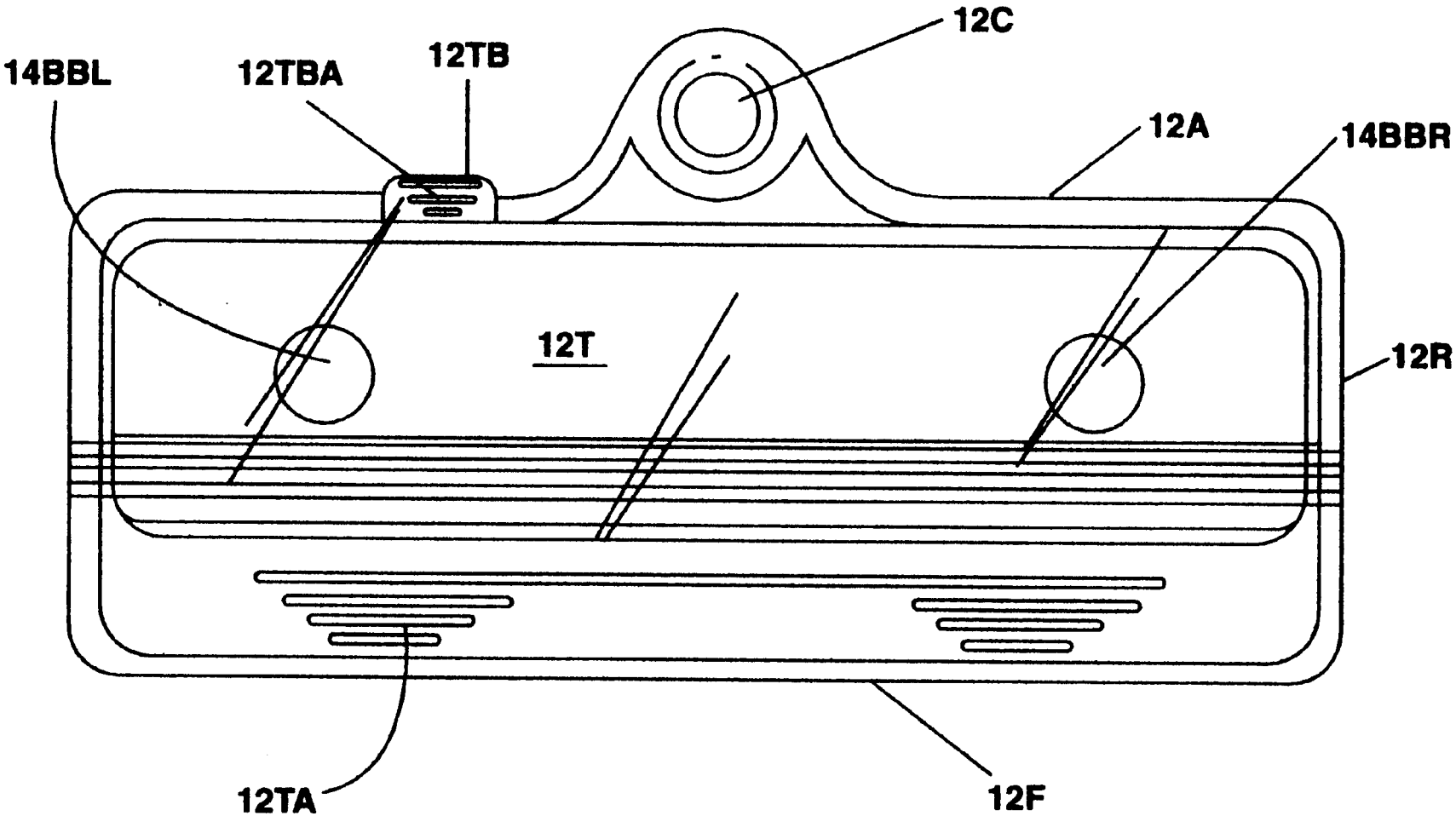
FIG. 2 is a Top view of a live hinge for clipboard clip box.

Referring to FIG. 1, FIG. 2, FIG. 6, and FIG. 7 which are a left, top, rear, and front perspective views, respectively, of a live hinge for clipboard clip box (10) comprising a cover (12) which comprises a cover rear (12A), cover front (12F), cover left side (12L), cover right side (12R), cover top (12T), and cover bottom (12B). The box rear (14A) preferably comprises a box rear right hook (14AR) and a box rear left hook (14AL) extending downwardly from a rear end thereof The base (18) comprises a base right hook (18AR) and a base left hook (18AL) extending upwardly from a rear end thereof. A flexible right clip (22R) connects the box rear right hook (14AR) and the base right hook (18AR) and a flexible left clip (22L) connects the box rear left hook (14AL) and the base left hook (18AL).

The cover top (12T) may optionally comprise at least one cover top grip (12TA) positioned thereon functioning to facilitate opening of the cover top (12T) from the box (14). The cover top (12T) preferably comprises a cover top tab (12TB) extending rearwardly therefrom fumctioning to facilitate opening of the cover top (12T) from the box (14). The cover top tab (12TB)may optionally comprise a cover top tab grip (12TBA) functioning as an anti-slip.

The cover (12) may optionally further comprise a cover eyelet (12C) extending rearwardly therefrom functioning to hold a writing utensil.

The box rear (14A) preferably further comprises a box rear lock (14AB) positioned complimentary to the cover top tab (12TB) removably engaging therewith.

The box bottom (14B) preferably comprises at least one box bottom holder extending downwardly therefrom functioning as a gripping means to hold the paper (26) against the top of the base (18). The at least one box bottom holder preferably comprises a box bottom right holder (14BBR) and a box bottom left holder (14BBL).

The cover (12) further comprises a cover skirt (12D) extending downwardly therefrom having a slightly larger diameter and complimentary configuration to a top of the box (14). The cover skirt (12D) functions as a sealing means to prevent rain from entering the box (14) as well as preventing writing utensils from falling out therefrom.

The live hinge for clipboard clip box (10) further comprises a box (14) which comprises a box rear (14A), box front (14F), box bottom (14B), box left (14L), and box right (14R), the cover top (12T) is hingeably connected along a front to a top distal end of the box front (14F). The box (14) may optionally further comprise a holder (16) securely attached thereon functioning to hold a writing utensil in a horizontal position. The holder (16) is securely attached to the box rear (14A).

Figure 3:
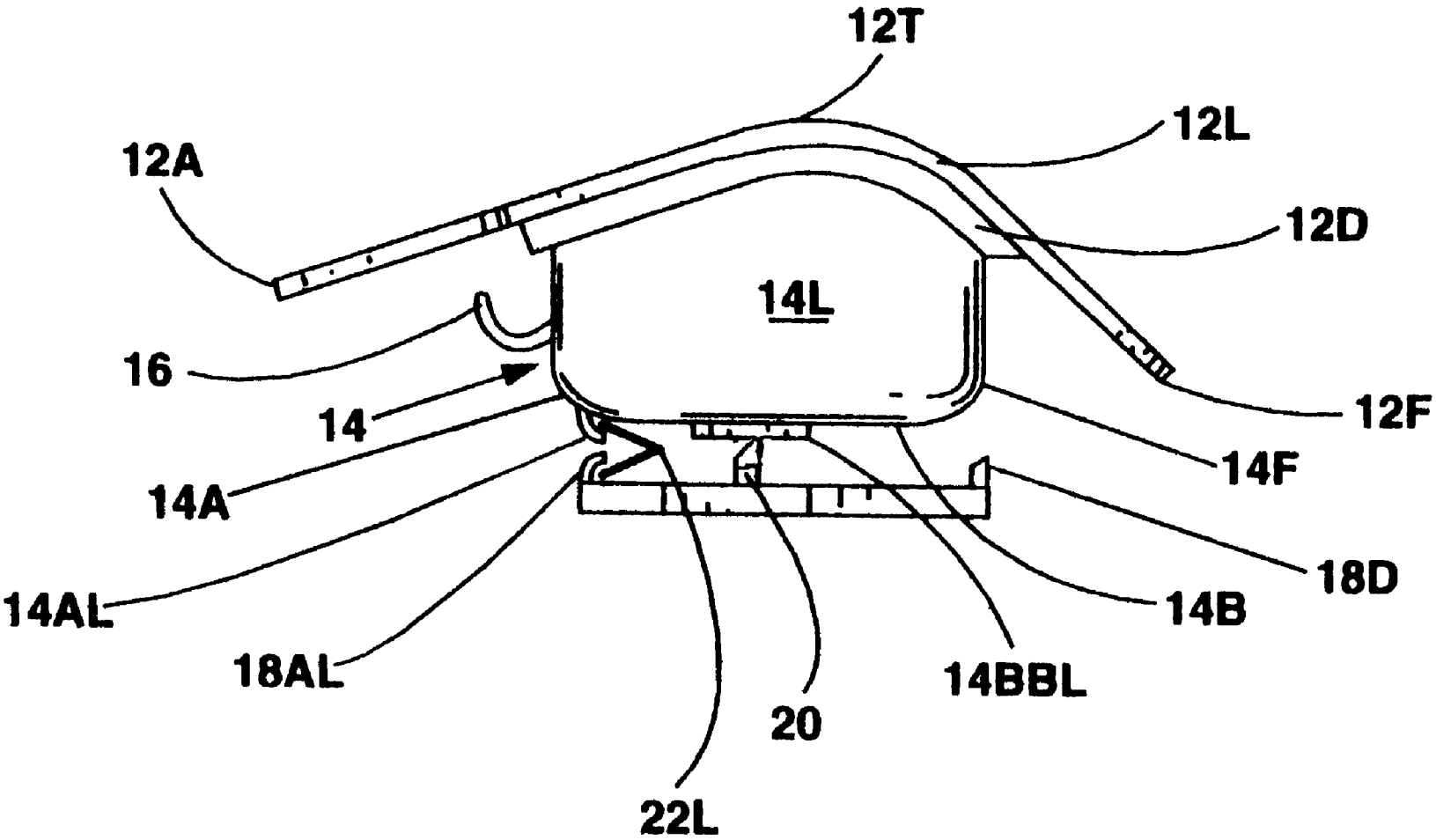
FIG. 3 is a left side view of a live hinge for clipboard clip box.
Figure 4:
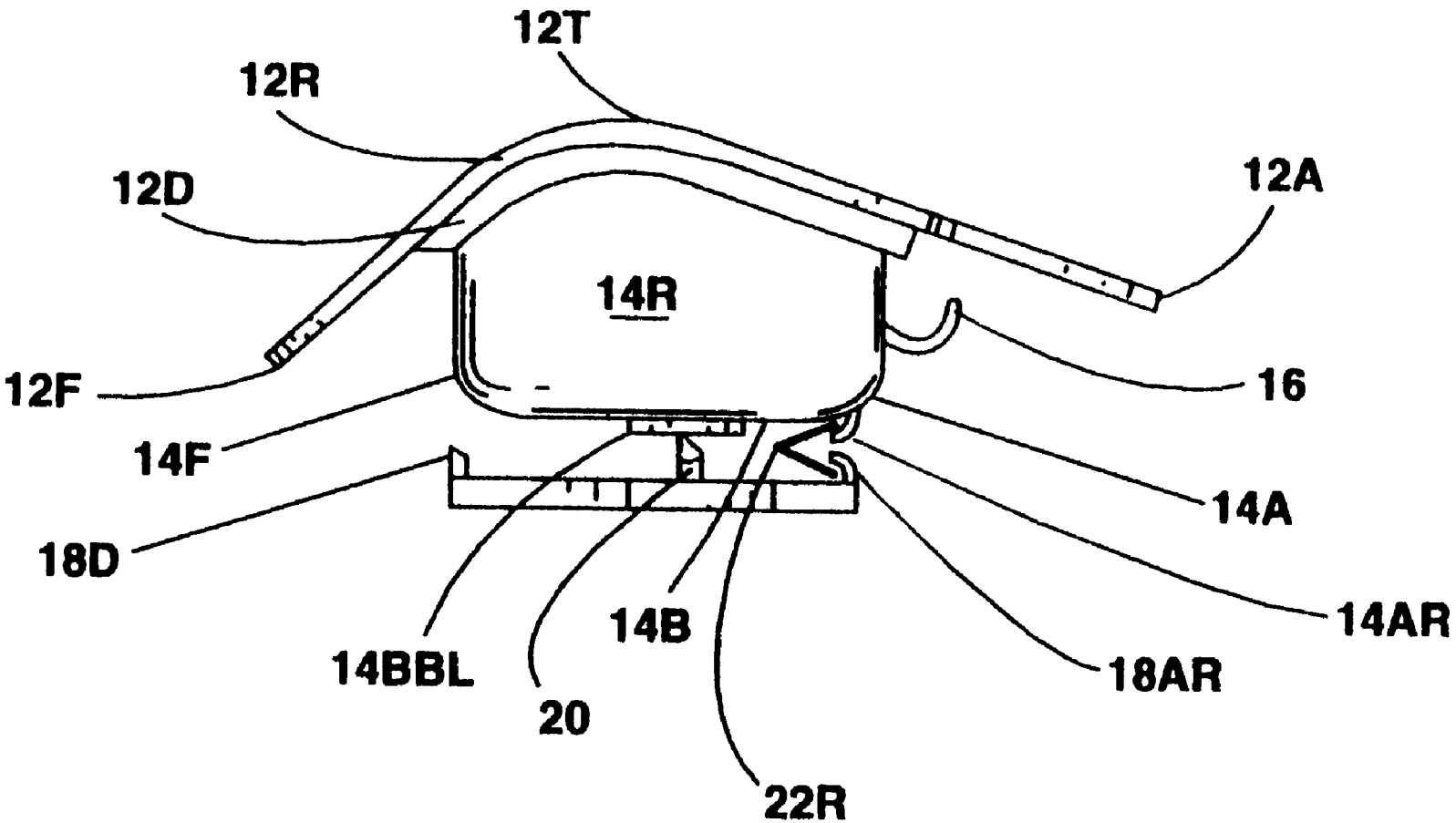
FIG. 4 is a right side view of a live hinge for clipboard clip box.
Figure 5:
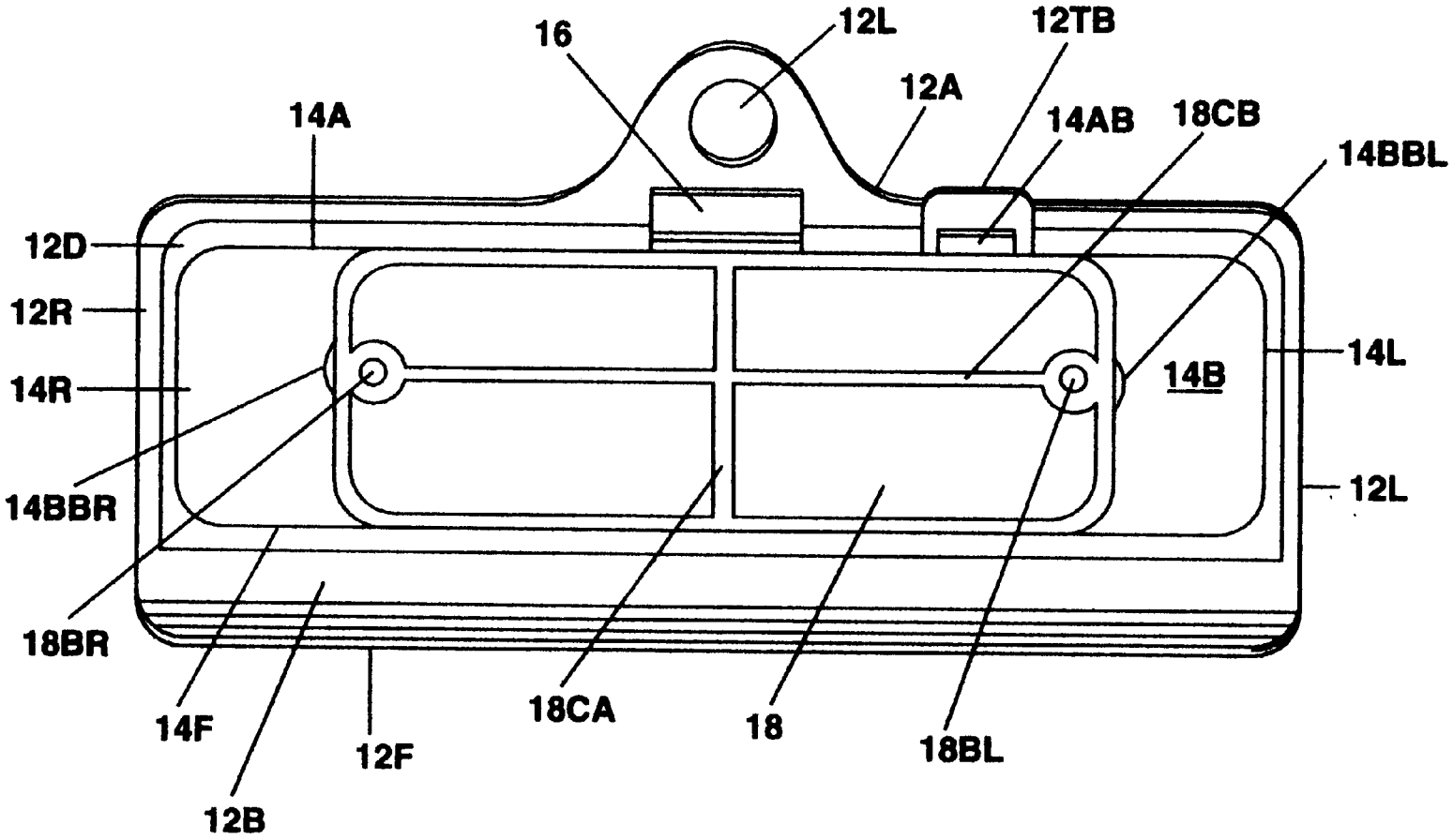
FIG. 5 is a bottom view of a live hinge for clipboard clip box.
Figure 6:
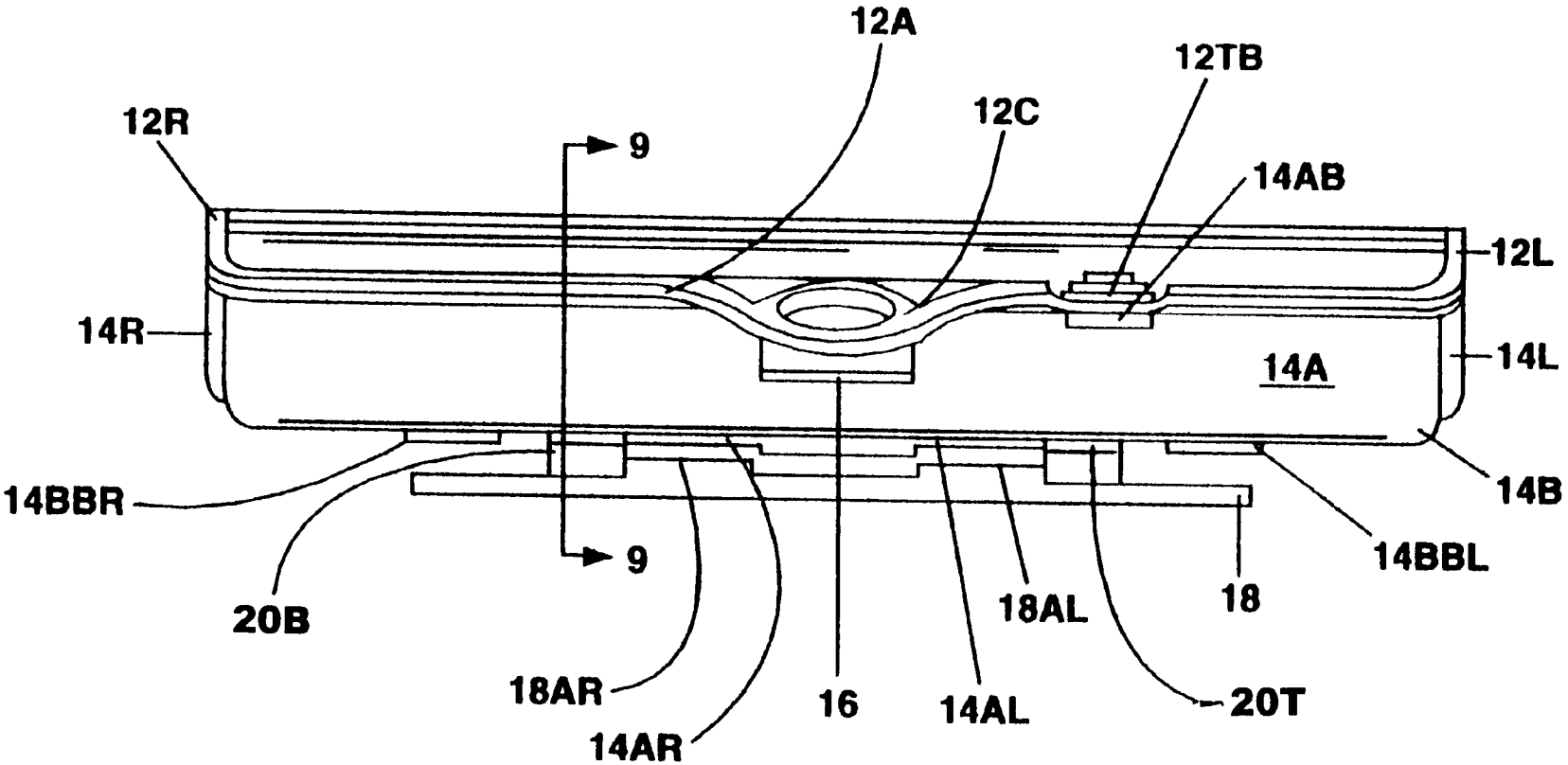
FIG. 6 is a rear veiw of a live hinge for clipboard clip box.
Figure 7:
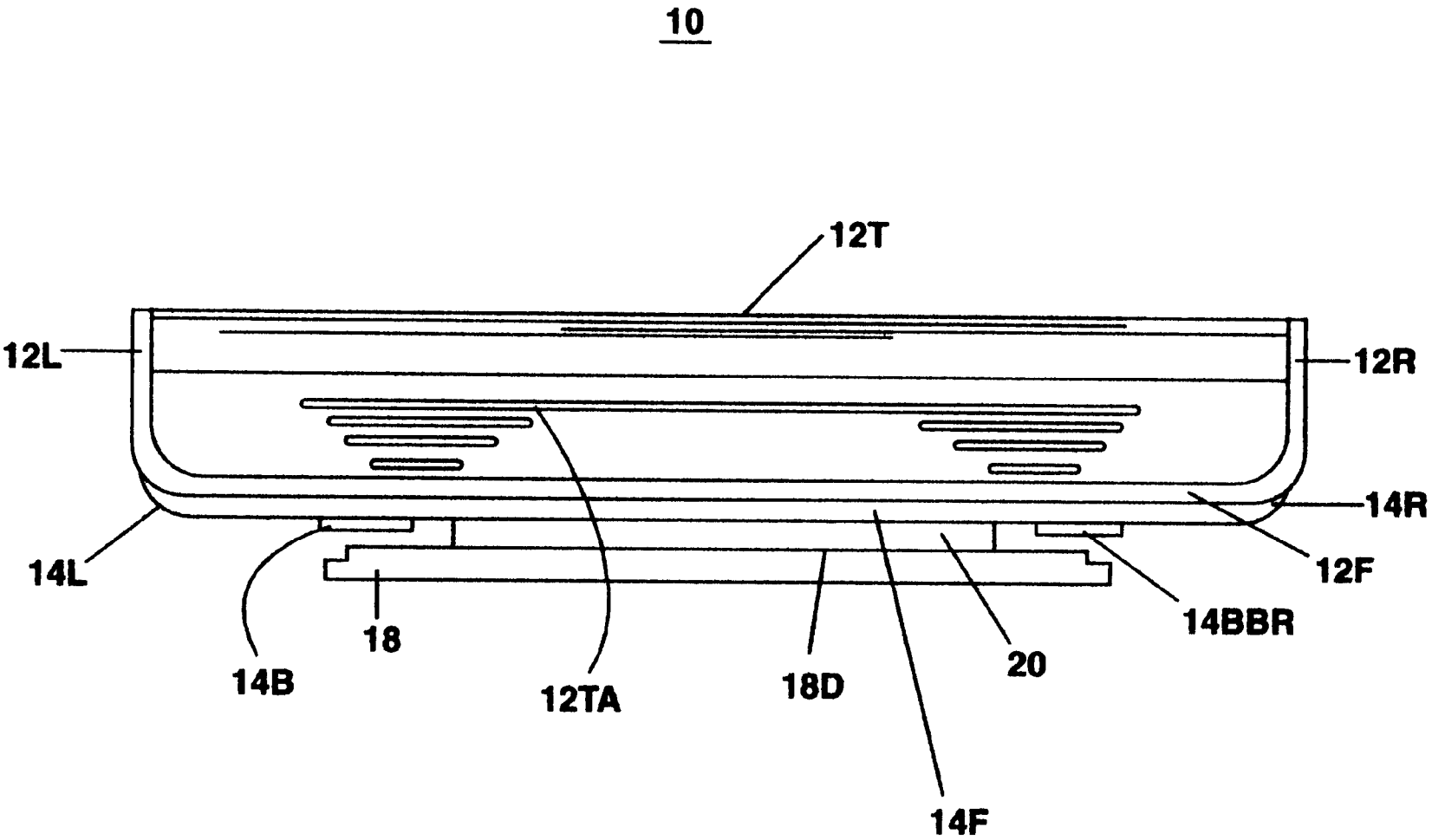
FIG. 7 is a front view of a live hinge for clipboard clip box.
Figure 9:
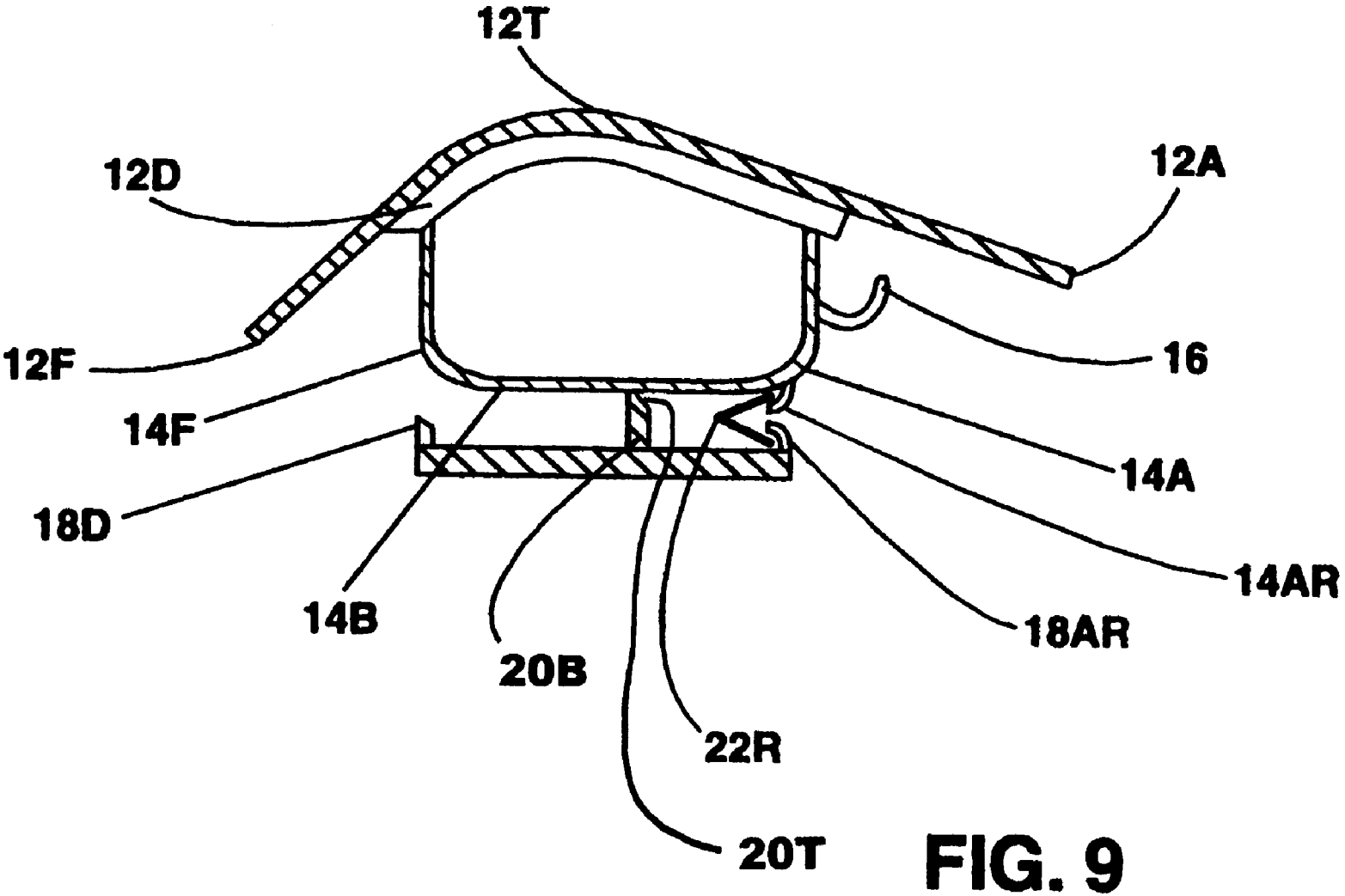
FIG. 9 is a cross sectional view of a live hinge for clipboard clip box along line 9—9 of FIG. 6.

Now referring to FIG. 3 and FIG. 4 which are left and right side views of a live hinge for clipboard clip box (10) and FIG. 9 which is a cross sectional view of a live hinge for clipboard clip box (10) along line 9—9 of FIG. 6. The live hinge for clipboard clip box (10) further comprises a base (18) connected to the box bottom (14B) by a hinge (20). As best shown in FIG. 6 and FIG. 9, the hinge (20) includes a hinge top (20T) and a hinge bottom (20B). A feature of the invention is that the hinge bottom (20B) is of a thickness that enhances stiffness, about 0.08 to 0.15 inches, while the hinge top (20T) tapers vertically to a relatively thin thickness, about 0.025 to 0.05 inches, to promote flexibility at the extreme top of hinge top (20T). The base (18) preferably further comprises at least one opening therein through which a fastener attaches the board (24). The at least one opening preferably comprises a base right opening (18BR) and a base left opening (18BL). The base (18) preferably further comprises at least one base front-back ridge (18CA) functioning as a reinforcing means. The base (18) preferably further comprises at least one base left-right ridge (18CB) functioning as a reinforcing means. The base (18) may optionally further comprise abase rest (18D) extending upwardly from a front edge of the base (18) functioning to grasp the paper (26) against the box bottom (14B).

The cover (12), box (14), base (18), and hinge (20) are a unitary, one-piece, molded construction. The cover (12), box (14), base (18), and hinge (20) are constructed from a material selected from a group consisting of thermoplastic injection-molded plastic, thermosetting plastic, plastic composite, epoxy, carbon-graphite, fiberglass, rubber, rubber composite, metal, and metal alloy.

The live hinge for clipboard clip box (10) further comprises a board (24) securely attached at a top to the base (18). The board (24) is constructed from a material selected from a group consisting of plastic, plastic composite, wood, wood composite, epoxy, carbon-graphite, fiberglass, rubber, rubber composite, metal, and metal alloy.

Figure 8:
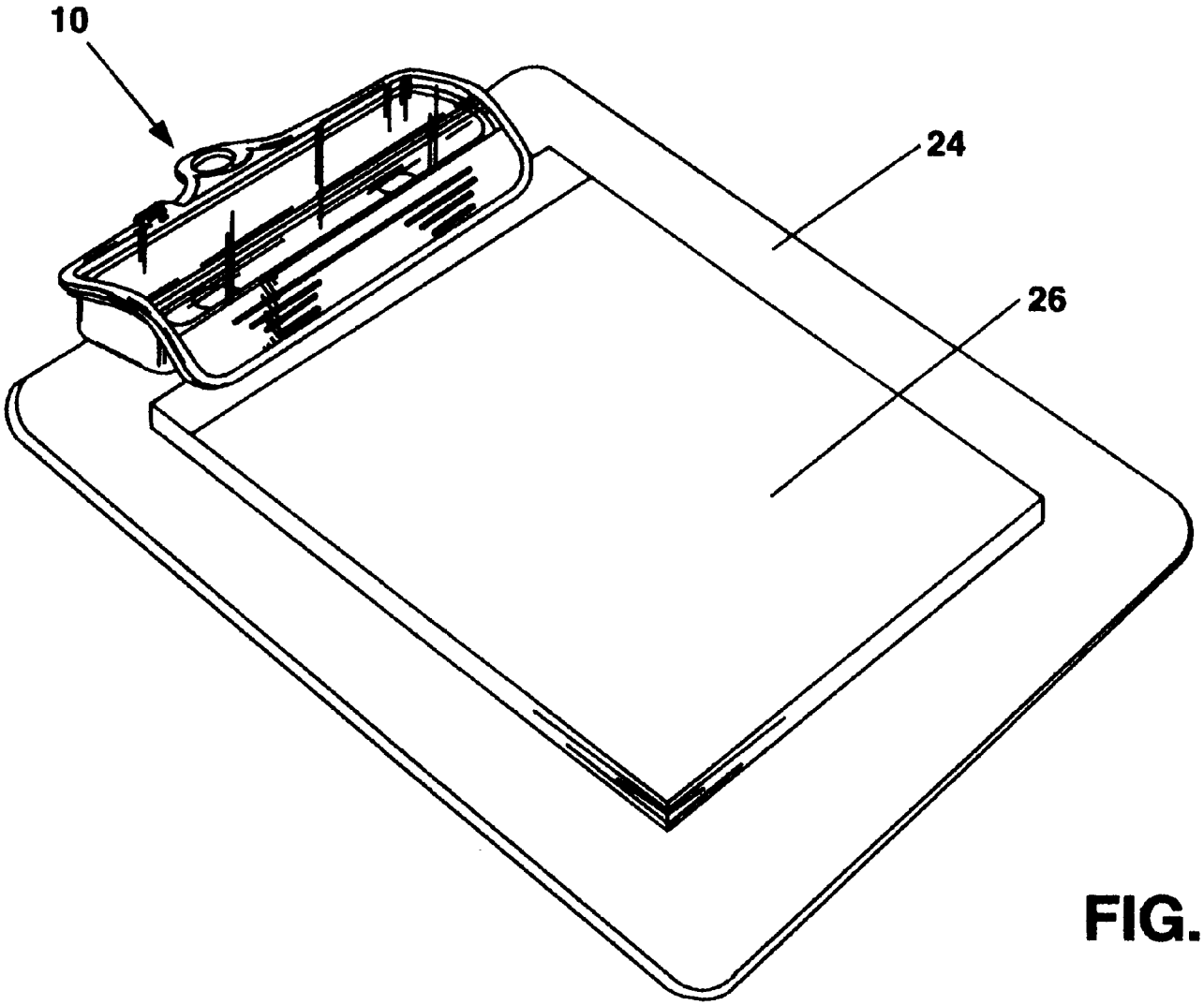
FIG. 8 is a left front top perspective view of a live hinge for clipboard clip box attached to a top of a board holding paper.

Referring to FIG. 8 which is a left front top perspective view of a live hinge for clipboard clip box (10) attached to a top of a board (24) holding paper (26). A user lifts box front (14F) pivoting the box (14) upwardly on the hinge (20) inserting paper (26) from a frontward direction between a top of the base (18) and the box bottom (14B).

It will be understood that each of the elements described above, or two or more together, may also find a useful application in other types of constructions differing from the type described above.

While the invention has been illustrated and described as embodied in a clipboard, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Whereas, the present invention has been described with respect to a specific embodiment thereof, it will be understood that various changes and modifications will be suggested to one skilled in the art and it is intended to encompass such changes and modifications as fall within the scope of the appended claims.

I claim:

1. A clipboard clip box having a live hinge comprising:

A) a cover (12) which comprises a cover rear (12A), cover front (12F), cover left side (12L), cover right side (12R), cover top (12T), and cover bottom (12B);

B) a box (14) which comprises a box rear (14A), box front (14F), box bottom (14B), box left (14L), and box right (14R), the cover top (12T), is hingeably connected along a front to a top distal end of the box front (14F);

C) a base (18) connected to a rear portion of the box bottom (14B) by a hinge (20); and D) a board (24) securely attached at a top to the base (18), such that a user lifts box front (14F) pivoting the box (14) upwardly on the hinge (20 in a first rotational direction inserting paper (26) from a frontward direction between a top of the base (18) and the box bottom (14B) and such that the user lifts the cover rear portion in a second rotational direction for access to said box.

2. A clipboard clip box having a live hinge (10) as described in claim 1, wherein the box rear (14A) comprises a box rear right hook (14AR) and a box rear left hook (14AL) extending downwardly from a rear end thereof, the base (18) comprises a base right hook (18AR) and abase left hook (18AL) extending upwardly from a rear end thereof, a flexible right clip (22R) connects the box rear right hook (14AR) and the base right hook (18AR) and a flexible left clip (22L) connects the box rear left hook (14AL) and the base left hook (18AL).

3. A clipboard clip box having a live hinge (10) as described in claim 1, wherein the cover top (12T) comprises at least one cover top grip (12TA) positioned thereon functioning to facilitate opening of the cover lop (12T) from the box (14).

4. A clipboard clip box having a live hinge (10) as described in claim 1, wherein the cover top (12T) further comprises a cover top tab (12TB) extending rearwardly therefrom functioning to facilitate opening of the cover top (12T) from the box (14).

5. A clipboard clip box having a live hinge (10) as described in claim 4, wherein the cover top tab (12TB) comprises a cover top tab grip (12TBA) functioning as an anti-slip.

6. A clipboard clip box having a live hinge (10) as described in claim 1, wherein the cover (12) further comprises a cover eyelet (12C) extending rearwardly therefrom functioning to hold a writing utensil.

7. A clipboard clip box having a live hinge (10) as described in claim 1, wherein the box rear (14A) further comprises a box rear lock (14AB) positioned complimentary to the cover top tab (12TB) removably engaging therewith.

8. A clipboard clip box having a live hinge (10) as described in claim 1, wherein the box bottom (14B) comprises at least one box bottom holder extending downwardly therefrom functioning as a gripping means to hold the paper (26) against the top of the base (18).

9. A clipboard clip box having a live hinge (10) as described in claim 8, wherein the at least one box bottom holder comprises a box bottom right holder (14BBR) and a box bottom left holder (14BBL).

10. A clipboard clip box having a live hinge (10) as described in claim 1, wherein the cover (12) further comprises a cover skirt (12D) extending downwardly therefrom having a slightly larger diameter and complimentary configuration to a top of the box (14).

11. A clipboard clip box having a live hinge (10) as described in claim 1, wherein the box (14) further comprises a holder (16) securely attached thereon functioning to hold a writing utensil in a horizontal position.

12. A clipboard clip box having a live hinge (10) as described in claim 11, wherein the holder (16) is securely attached to the box rear (14A).

13. A clipboard clip box having a live hinge (10) as described in claim 1, wherein the base (18) further comprises at least one opening therein through which a fastener attaches the board (24).

14. A clipboard clip box having a live hinge (10) as described in claim 13, wherein the at least one opening comprises a base right opening (18BR) and a base left opening (18BL).

15. A clipboard clip box having a live hinge (10) as described in claim 1, wherein the base (18) further comprises at least one base front-back ridge (18CA) functioning as a reinforcing means.

16. A clipboard clip box having a live hinge (10) as described in claim 15, wherein the base (18) further comprises at least one base left-right ridge (18CB) functioning as a reinforcing means.

17. A clipboard clip box having a live hinge (10) as described in claim 1, wherein the base (18) further comprises a base rest (18D) extending upwardly from a front edge of the base (18) functioning to grasp the paper (26) against the box bottom (14B).

18. A clipboard clip box having a live hinge (10) as described in claim 1, wherein the cover (12), box (14), base (18), and hinge (20) are constructed from a material selected from a group consisting of thermoplastic injection-molded plastic, thermosetting plastic, plastic composite, epoxy, carbo-n-graphite, fiberglass, rubber, rubber composite, metal, and metal alloy.

19. A clipboard clip box having a live hinge (10) as described in claim 1, wherein the board (24) is constructed from a material selected from a group consisting of thermoplastic injection-molded plastic, thermosetting plastic, plastic composite, epoxy, carbon-graphite, fiberglass, rubber, rubber composite, metal, and metal alloy.

20. A clipboard having a live hinge comprising:

A) a base (18) connected to the live hinge (20), with the hinge (20) including a hinge top (20T) and a hinge bottom (20B), with the hinge bottom (20B) secured to said base and of a thickness that enhances stiffness, while the hinge top (20T) tapers vertically to a relatively thin thickness to promote flexibility at the extreme top of hinge top (20T), said hinge top connected to a clip;

B) a board (24) securely attached at a top to the base (18), such that a user lifts a clip front (14F) of said clip pivoting the clip upwardly on the live hinge (20) inserting paper (26) from a frontward direction between a top of the base (18) and the clip bottom (14B); and C) the clip bottom (14B), base (18) and live hinge (20) being formed of a unitary, one-piece, molded, plastic construction.

* * * * *